US007369094B2

(12) United States Patent
Song et al.

(10) Patent No.: US 7,369,094 B2
(45) Date of Patent: May 6, 2008

(54) DUAL-FREQUENCY HIGH-GAIN ANTENNA

(75) Inventors: Jia-Jiu Song, Jhonghe (TW); Wei-Tong Cheng, Hsinchu (TW)

(73) Assignee: Smartant Telecom Co., Ltd., Hsinchu County (TW)

( * ) Notice: Subject to any disclaimer, the term of this patent is extended or adjusted under 35 U.S.C. 154(b) by 0 days.

(21) Appl. No.: 11/526,663

(22) Filed: Sep. 26, 2006

(65) Prior Publication Data

US 2008/0074340 A1 Mar. 27, 2008

(51) Int. Cl.
*H01Q 21/00* (2006.01)

(52) U.S. Cl. ..... 343/816; 343/820; 343/810

(58) Field of Classification Search ..... 343/700 MS, 343/793, 810, 816, 820
See application file for complete search history.

(56) References Cited

U.S. PATENT DOCUMENTS 7,102,586 B2 * 9/2006 Liang et al. ..... 343/795
7,215,285 B2 * 5/2007 Song et al. ..... 343/700 MS
2005/0073465 A1 * 4/2005 Olson ..... 343/795
2007/0063913 A1 * 3/2007 Wu et al. ..... 343/824

* cited by examiner

*Primary Examiner*—Hoang V Nguyen
(74) *Attorney, Agent, or Firm*—Rabin & Berdo, P.C.

(57) ABSTRACT

A dual-frequency high-gain antenna is provided, which includes: a diplexer loop portion disposed at the center of the antenna substrate for receiving a feed signal; two single-frequency radiation units, symmetrically connected to two sides of the diplexer loop portion for radiating a radio-frequency signal corresponding to a first frequency value of the feed signal; and two dual-frequency radiation units, respectively connected to each single-frequency radiation portion for radiating radio-frequency signals corresponding to the first frequency value and a second frequency value of the feed signal.

12 Claims, 11 Drawing Sheets

DUAL-FREQUENCY HIGH-GAIN ANTENNA

BACKGROUND OF THE INVENTION

1. Field of Invention

The present invention relates to a printed circuit board (PCB) antenna, and more particularly to a dual-frequency high-gain antenna.

2. Related Art

Along with the development of wireless communication technology, information can be transmitted by a wireless communication system without the limitation of geography. Being one of the most important elements in the wireless communication field, the current antenna is preferably fabricated by means of PCB with various advantages such as being simple and low in cost.

At present, the standard of wireless transmission is constituted by the Institute of Electrical and Electronics Engineers (IEEE), so as to make the wireless transmission technology widely utilized, and ensure that the devices produced by various manufacturers are compatible and stable.

In an ordinary radio-frequency circuit, passive parts are frequently used, such as antenna, diplexer, high low band stop filter, balun, power divider and coupler, wherein the antenna is an important element that has impact on the signal transmission quality. With the co-existence of the 2.4 GHz frequency band and 5 GHz frequency band on a communication chip, the antenna must simultaneously receive frequencies of the two frequency bands. However, in general, the dual-frequency antenna has the disadvantages of being insufficient in bandwidth and gain and has the problem of being difficult to integrate.

Therefore, how to provide a dual-frequency high-gain antenna to improve the signal transmission bandwidth thereof has become a problem to be settled by the researchers.

SUMMARY OF THE INVENTION

In view of the above, the main objective of the present invention is to provide a dual-frequency high-gain antenna, which utilizes the design of a diplexer loop portion, a single-frequency radiation unit and a dual-frequency radiation unit to improve the gain and bandwidth of the antenna, so as to increase the signal transmission distance.

Therefore, in order to achieve the above objective, the dual-frequency high-gain antenna disclosed in the present invention comprises a diplexer loop portion, two single-frequency radiation units and two dual-frequency radiation units.

The diplexer loop portion is disposed at the center of the antenna substrate for receiving a feed signal.

The two single-frequency radiation units are symmetrically connected to two sides of the diplexer loop portion for radiating a radio-frequency signal corresponding to a first frequency value of the feed signal, wherein each single-frequency radiation unit is of a dipole antenna structure.

The two dual-frequency radiation units are respectively connected to each single-frequency radiation portion for radiating radio-frequency signals corresponding to the first frequency value and a second frequency value of the feed signal, wherein each dual-frequency radiation unit is of a dipole antenna structure.

The single-frequency radiation unit further comprises a first frequency band radiation portion for radiating a radio-frequency signal of the first frequency value. The dual-frequency radiation unit further comprises a first frequency band radiation portion and a second frequency band radiation portion respectively for radiating radio-frequency signals of the first frequency value and the second frequency value.

Furthermore, in order to achieve the above objective, the dual-frequency high-gain antenna disclosed in the present invention comprises a diplexer loop portion and more than two dual-frequency radiation units.

The diplexer loop portion is disposed at the center of the antenna substrate for receiving a feed signal.

More than two dual-frequency radiation units are connected to the diplexer loop portion for radiating radio-frequency signals corresponding to a first frequency value and a second frequency value of the feed signal, wherein each dual-frequency radiation unit is of a dipole antenna structure.

The dual-frequency radiation unit further comprises a first frequency band radiation portion and a second frequency band radiation portion respectively for radiating radio-frequency signals of the first frequency value and the second frequency value.

Furthermore, in order to achieve the above objective, the dual-frequency high-gain antenna disclosed in the present invention comprises a signal feed portion, two single-frequency radiation units and two dual-frequency radiation units.

The signal feed portion is disposed at the center of the antenna substrate for receiving a feed signal.

The two single-frequency radiation units are symmetrically connected to two sides of the signal feed portion for radiating a radio-frequency signal corresponding to a first frequency value of the feed signal, wherein each single-frequency radiation unit is of a dipole antenna structure.

The two dual-frequency radiation units are respectively connected to each single-frequency radiation portion for radiating radio-frequency signals corresponding to the first frequency value and a second frequency value of the feed signal, wherein each dual-frequency radiation unit is of a dipole antenna structure.

The single-frequency radiation unit further comprises a first frequency band radiation portion for radiating a radio-frequency signal of the first frequency value. The dual-frequency radiation unit further comprises a first frequency band radiation portion and a second frequency band radiation portion respectively for radiating radio-frequency signals of the first frequency value and the second frequency value.

With the dual-frequency high-gain antenna, a radio-frequency signal is transmitted and received through the diplexer loop portion, so as to provide the antenna with the characteristics of receiving/sending a signal, and the design of a single-frequency radiation section and a dual-frequency radiation section also enhances the signal receiving/sending gains of the antenna.

The features and practice of the preferred embodiments of the present invention will be illustrated in detail below with the accompanying drawings.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1:
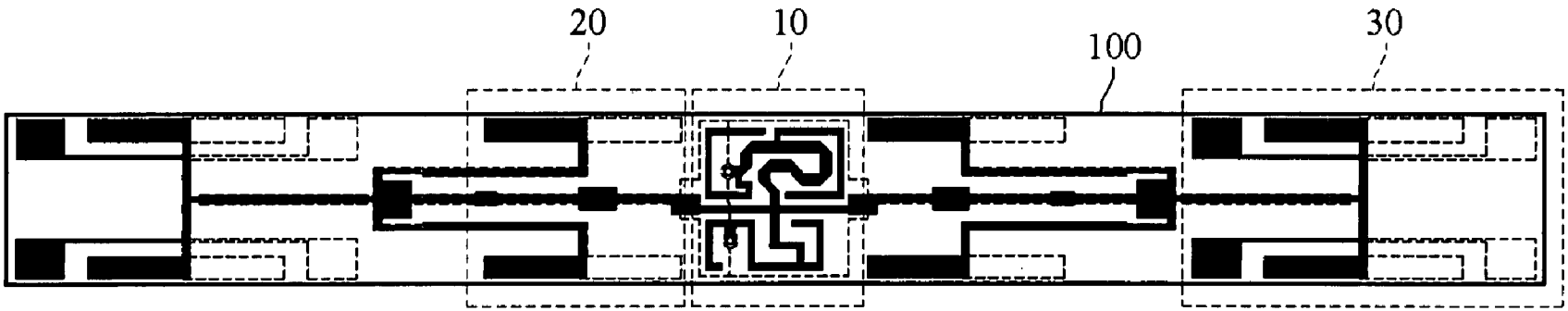
FIG. 1 is a schematic view of the appearance of an antenna substrate according to the first embodiment of the present invention.

Referring to FIG. 1, it is a schematic view of the appearance of an antenna substrate according to a first embodiment of the present invention. The antenna substrate 100 is provided with a diplexer loop portion 10, two single-frequency radiation units 20 and two dual-frequency radiation units 30.

Figure 2A:
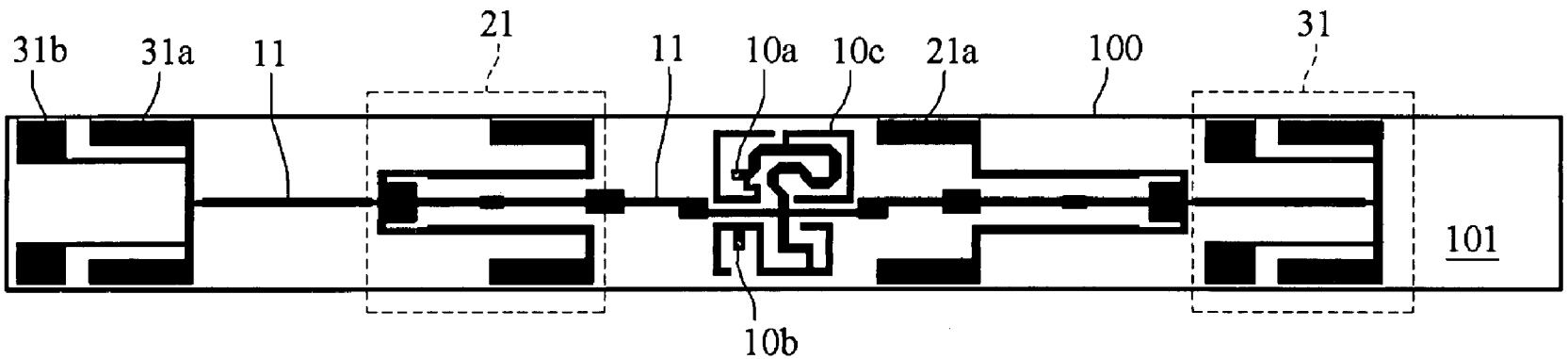
FIG. 2A is a front view of the first surface of the antenna substrate according to the first embodiment of the present invention.

The diplexer loop portion 10 includes two signal feed portions, i.e., a first signal feed portion 10*a* and a second signal feed portion 10*b* (as shown in FIG. 2A). The first signal feed portion 10*a* and the second signal feed portion 10*b* are respectively connected to a corresponding meandering microstrip line section 10*c* for providing a signal transmitting path and a signal receiving path, and filtering out a transmitting signal and a receiving signal through a filtering line (not shown).

The two single-frequency radiation units 20 are respectively disposed on two sides of the diplexer loop portion 10 and connected to the diplexer loop portion 10 through a microstrip line for receiving and radiating a feed signal, wherein the single-frequency radiation unit 20 is of a dipole antenna structure.

The two dual-frequency radiation units 30 are connected to the single-frequency radiation units 20 through a microstrip line, for receiving and radiating a feed signal, wherein the dual-frequency radiation unit 30 is of a dipole antenna structure.

Furthermore, the antenna feeds a signal by means of central feed characterized in a symmetrical radiation pattern and relatively reduces the feed loss, so as to enhance the receiving/sending gains of the antenna. In addition, the single-frequency radiation unit 20 and the dual-frequency radiation unit 30 are connected in series and the receiving/sending gains can be regulated by altering the quantity of the seriesly-connected single-frequency radiation units 20 or dual-frequency radiation units 30.

Referring to FIG. 2A, it is a front view of the first surface of the antenna substrate according to the first embodiment of the present invention. The first surface 101 of the antenna substrate 100 is provided with the first signal feed portion 10*a*, the second signal feed portion 10*b*, the meandering microstrip line section 10*c*, a single-frequency radiation signal portion 21 and a dual-frequency radiation signal portion 31.

The first signal feed portion 10*a* and the second signal feed portion 10*b* are respectively connected to the corresponding meandering circuit section 10*c* for providing a signal transmitting path and a signal receiving path and filtering out a transmitting signal and a receiving signal through a filtering line (not shown). The two side edges of the meandering circuit section 10*c* of the diplexer loop portion 10 are respectively connected to a single-frequency radiation signal portion 21.

The single-frequency radiation signal portions 21 are respectively disposed on two sides of the diplexer loop portion 10 and connected to the diplexer loop portion 10 through a microstrip line 11 for receiving and radiating a feed signal. In addition, each single-frequency radiation signal portion 21 includes a first frequency band radiation signal portion 21*a* for radiating a radio-frequency signal of the first frequency value (for example, 5 GHz).

The dual-frequency radiation signal portions 31 are connected to the single-frequency radiation portions 20 through the microstrip line 11 for receiving and radiating a feed signal. Each dual-frequency radiation signal portion 31 includes a first frequency band radiation signal portion 31*a* and a second frequency band radiation signal portion 31*b* respectively for radiating radio-frequency signals of the first frequency value (for example, 5 GHz) and the second frequency value (for example, 2.4 GHz).

Figure 2B:
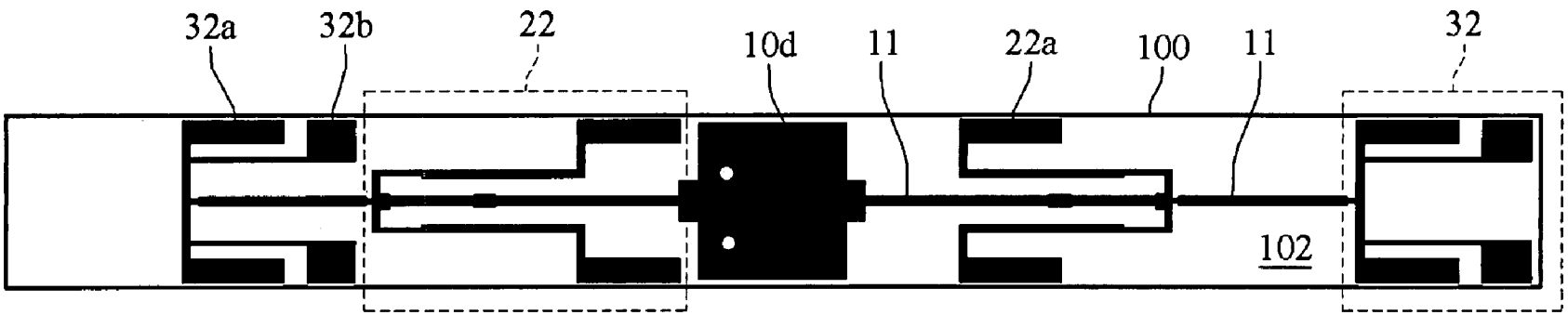
FIG. 2B is a front view of the second surface of the antenna substrate according to the first embodiment of the present invention.

Referring to FIG. 2B, it is a front view of the second surface of the antenna substrate according to the first embodiment of the present invention. The second surface 102 of the antenna substrate 100 is a ground-plane line with a line pattern corresponding to the shape of the first surface 101, which includes a diplexer loop ground portion 10*d*, single-frequency radiation ground portions 22 and dual-frequency radiation ground portions 32.

The diplexer loop ground portion 10*d* has an approximately rectangular-shaped ground plane including two ground feed points respectively corresponding to the positions of the first signal feed portion 10*a* and the second signal feed portion 10*b*, for providing a ground loop of radio-frequency signals.

The single-frequency radiation ground portions 22 are respectively disposed on two sides of the diplexer loop ground portion 10*d* and connected to the diplexer loop ground portion 10*d* through the microstrip line 11. In addition, each single-frequency radiation ground portion 22 includes a first frequency band radiation ground portion 22*a* which is symmetrical with the first frequency band radiation signal portion 21*a*.

The dual-frequency ground portions 32 are connected to the single-frequency ground portions 22 through the microstrip line 11. Each dual-frequency ground portion 32 includes a first frequency band radiation ground portion 32*a* and a second frequency band radiation ground portion 32*b* respectively corresponding to the first frequency band radiation signal portion 31*a* and the second frequency band radiation signal portion 31*b*. Moreover, the first frequency band radiation signal portion 31*a* and the first frequency band ground portion 32*a* together form a first frequency band radiation portion, and the second frequency band radiation signal portion 31*b* and the second frequency band ground portion 32*b* together form a second frequency band radiation portion.

Figure 2C:
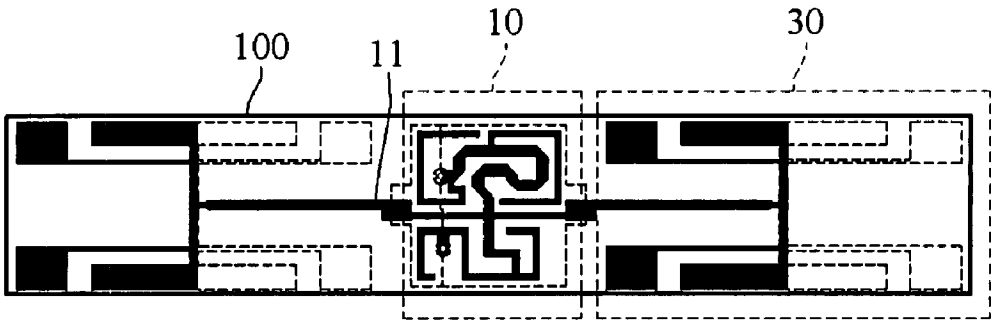
FIG. 2C is a schematic view of the appearance of an antenna substrate according to the second embodiment of the present invention.

Referring to FIG. 2C, it is a front view of the appearance of the antenna substrate according to a second embodiment of the present invention. The antenna substrate 100 is provided with a diplexer loop portion 10 and two dual-frequency radiation portions 30.

The diplexer loop portion 10 includes two signal feed portions, i.e., a first signal feed portion 10*a* and a second signal feed portion 10*b*, wherein the first signal feed portion 10*a* and the second signal feed portion 10*b* are respectively connected to a corresponding meandering microstrip line section 10*c* for providing a signal transmitting path and a signal receiving path, and filtering out a transmitting signal and a receiving signal through a filtering line (not shown).

The dual-frequency radiation units 30 are connected to the diplexer loop portion 10 through the microstrip line for receiving and radiating a feed signal. Each dual-frequency radiation unit 30 includes a first frequency band radiation portion 30*a* and a second frequency band radiation portion 30*b* respectively for radiating radio-frequency signals of the first frequency value (for example, 2.4 GHz) and the second frequency value (for example, 5 GHz).

Figure 2D:
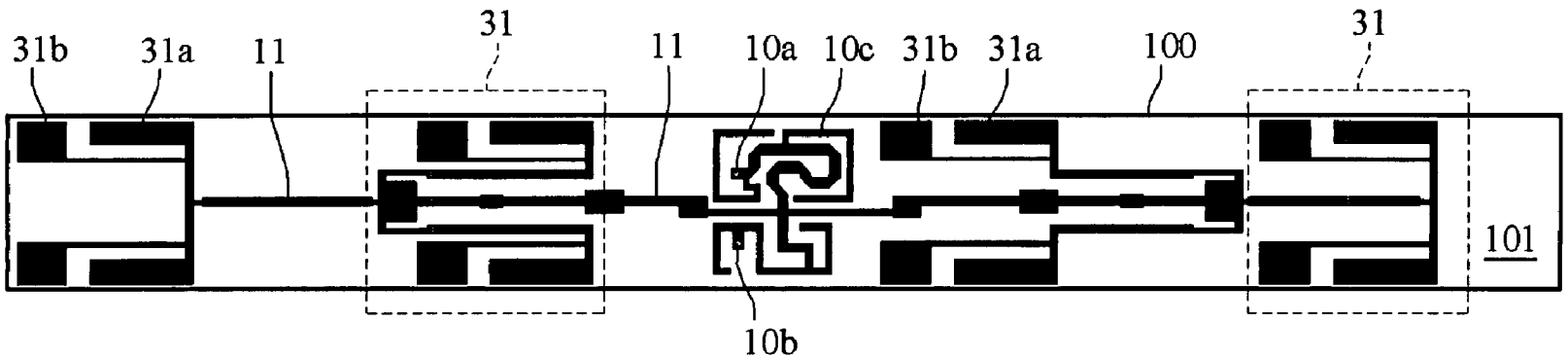
FIG. 2D is a front view of the first surface of the antenna substrate according to the third embodiment of the present invention.
Figure 2E:
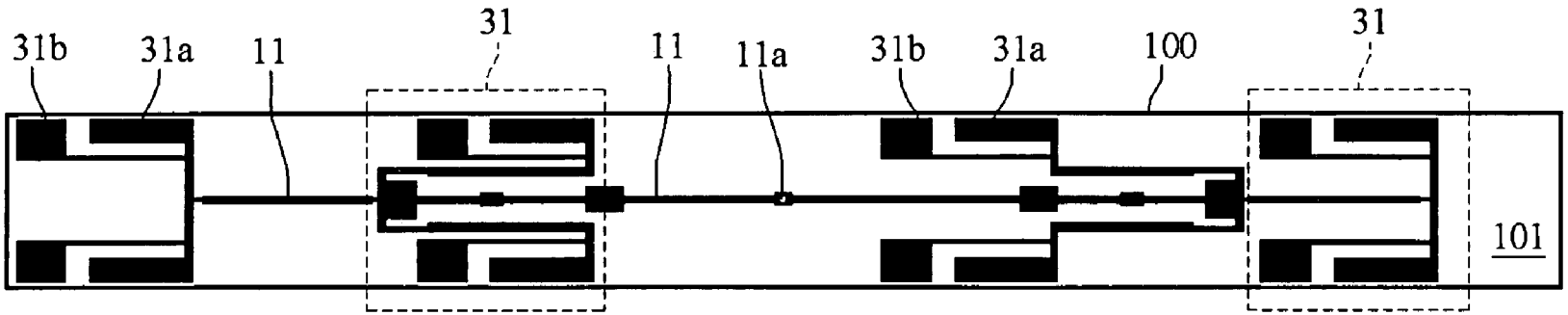
FIG. 2E is a front view of the first surface of the antenna substrate according to the fourth embodiment of the present invention.
Figure 2F:
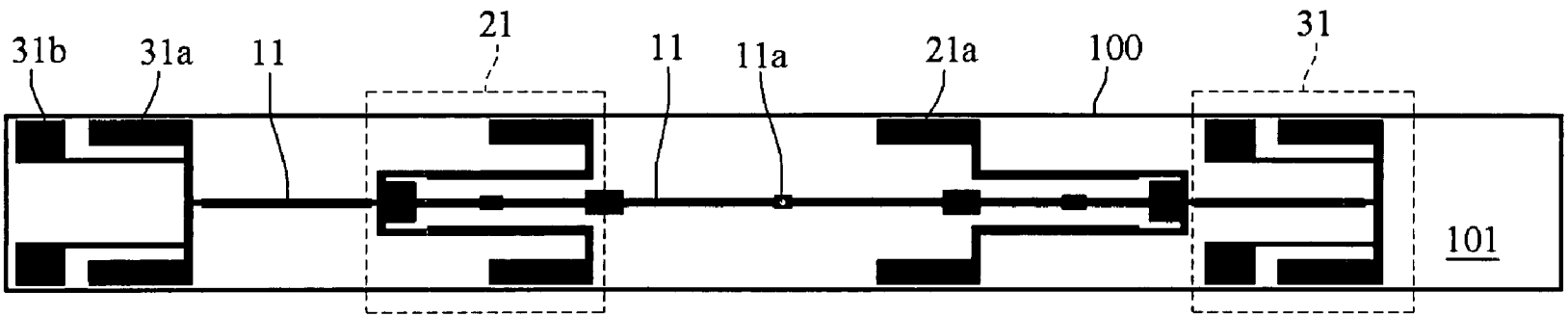
FIG. 2F is a front view of the first surface of the antenna substrate according to the fifth embodiment of the present invention.
Figure 2G:
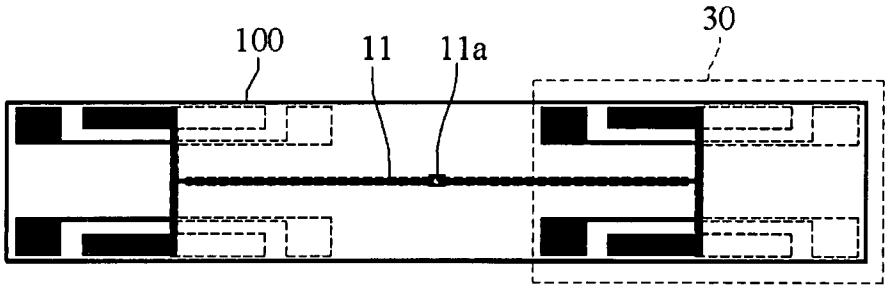
FIG. 2G is a front view of the first surface of the antenna substrate according to the sixth embodiment of the present invention.
Figure 2H:
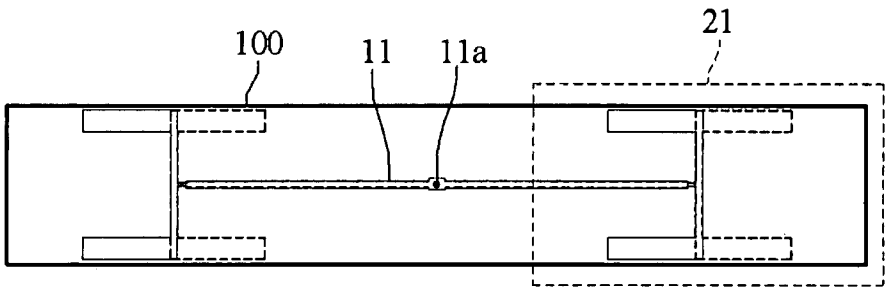
FIG. 2H is a front view of the first surface of the antenna substrate according to the seventh embodiment of the present invention.
Figure 2I:
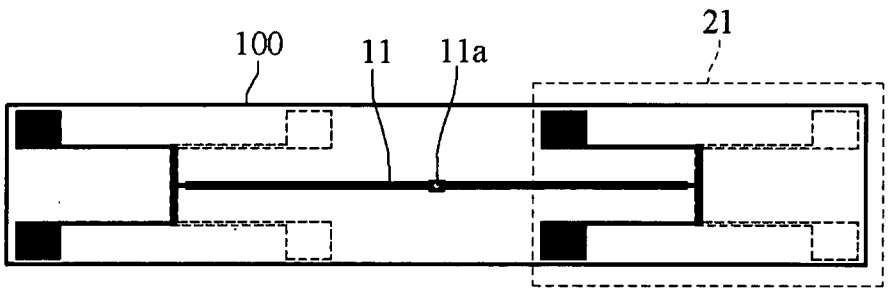
FIG. 2I is a front view of the first surface of the antenna substrate according to the eighth embodiment of the present invention.

Furthermore, the signal receiving/sending characteristics of the antenna can be modified by altering the quantity of the radiation units. Referring to FIG. 2D, it is a front view of the first surface of the antenna substrate according to a third embodiment of the present invention, which has a diplexer loop portion 10 connected to four dual-frequency radiation units 31, but a part of the structure is the same as that in the first embodiment, and the details will not be described herein again. Referring to FIG. 2E, it is a front view of the first surface of the antenna substrate according to a fourth embodiment of the present invention, which has a signal feed portion 11*a* disposed at the center of the antenna substrate 100, and connected to four dual-frequency radiation units 31 through a microstrip line 11, but a part of the structure is the same as that in the first embodiment, and the details will not be described herein again. Referring to FIG. 2F, it is a front view of the first surface of the antenna substrate according to a fifth embodiment of the present invention, which has a signal feed portion 11*a* disposed at the center of the antenna substrate 100, and connected to two single-frequency radiation units 21 and two dual-frequency radiation units 31 through a microstrip line 11, but a part of the structure is the same as that in the first embodiment, and the details will not be described herein again. Referring to FIG. 2G, it is a front view of the first surface of the antenna substrate according to a sixth embodiment of the present invention, which has a signal feed portion 11*a* disposed at the center of the antenna substrate 100, and connected to two dual-frequency radiation units 31 through a microstrip line 11, but a part of the structure is the same as that in the second embodiment, and the details will not be described herein again. Referring to FIG. 2H, it is a front view of the first surface of the antenna substrate according to a seventh embodiment of the present invention, which has a signal feed portion 11*a* disposed at the center of the antenna substrate 100, and connected to two single-frequency radiation units 21 through a microstrip line 11, but a part of the structure is the same as that in the second embodiment, and the details will not be described herein again. Referring to FIG. 2I, it is a front view of the first surface of the antenna substrate according to an eighth embodiment of the present invention, which has a signal feed portion 11*a* disposed at the center of the antenna substrate 100, and connected to two single-frequency radiation units 21 through a microstrip line 11, but a part of the structure is the same as that in the second embodiment, and the details will not be described herein again.

Figure 3A:
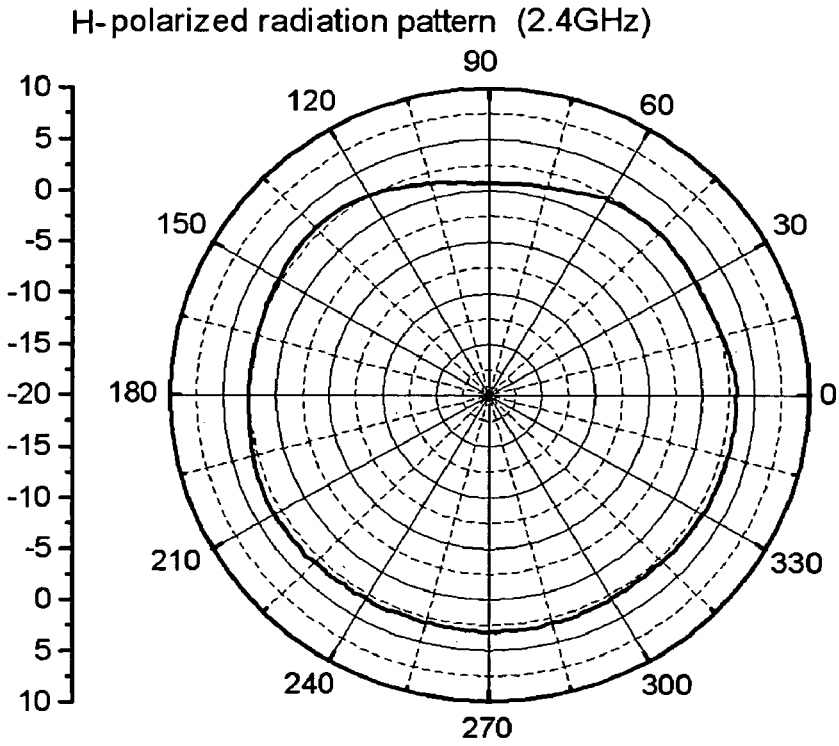
FIG. 3A is an H-polarized radiation pattern of the first frequency band according to the first embodiment of the present invention.
Figure 3B:
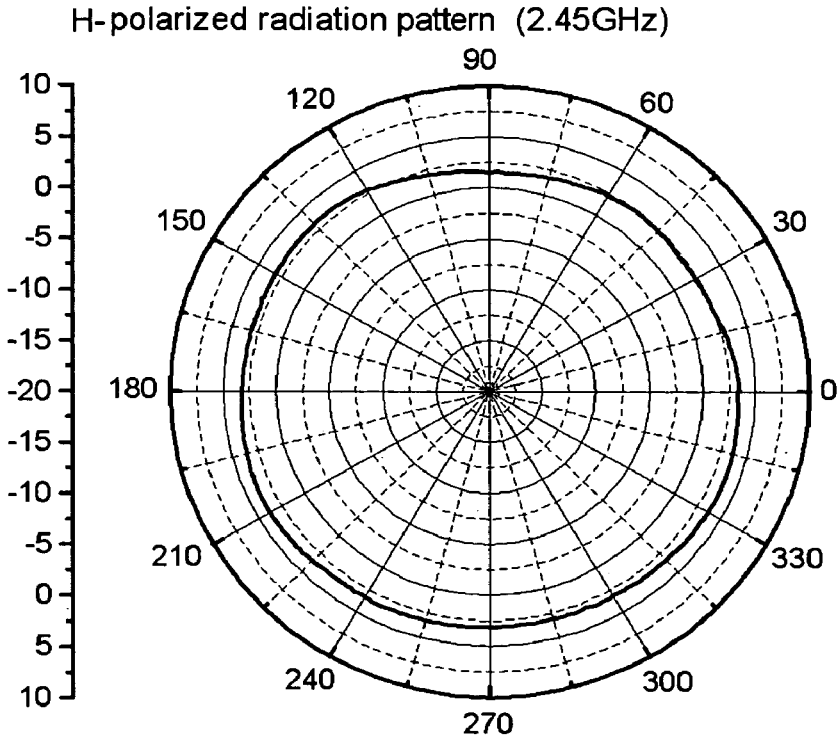
FIG. 3B is an H-polarized radiation pattern of the first frequency band according to the first embodiment of the present invention.
Figure 3C:
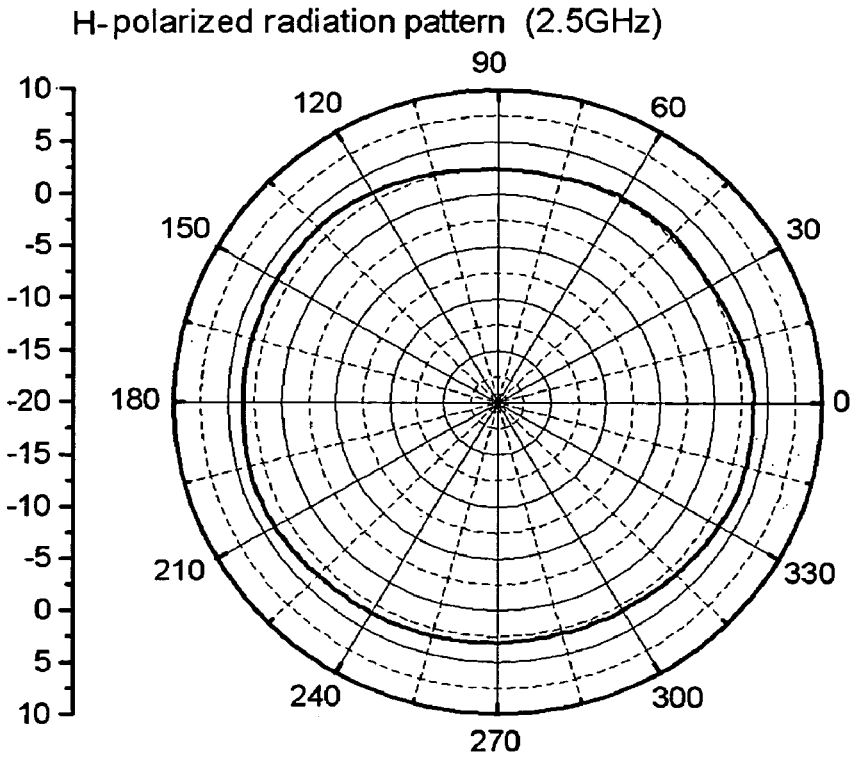
FIG. 3C is an H-polarized radiation pattern of the first frequency band according to the first embodiment of the present invention.
Figure 3D:
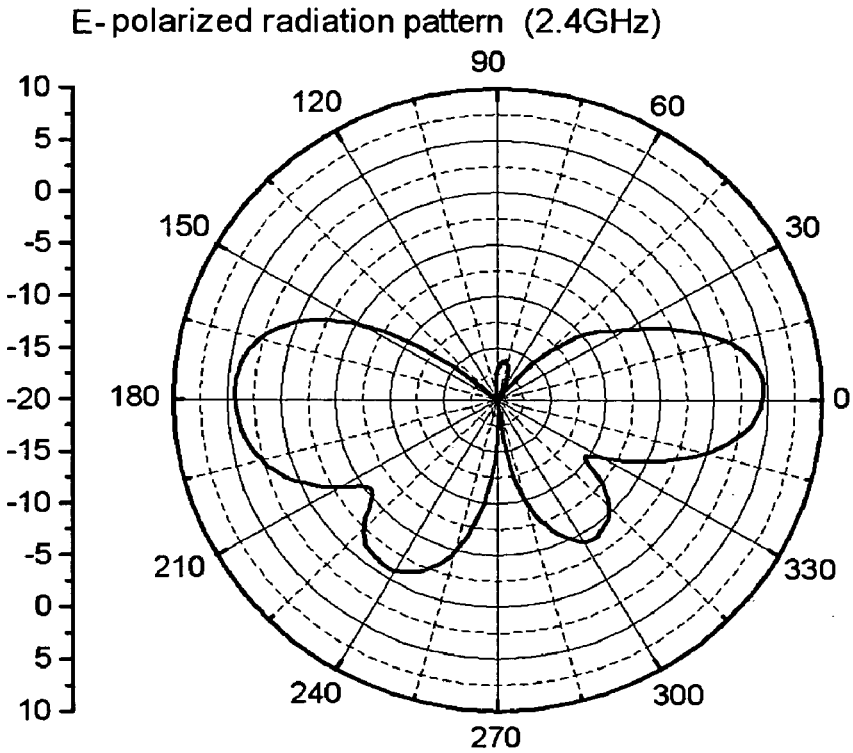
FIG. 3D is an E-polarized radiation pattern of the first frequency band according to the first embodiment of the present invention.
Figure 3E:
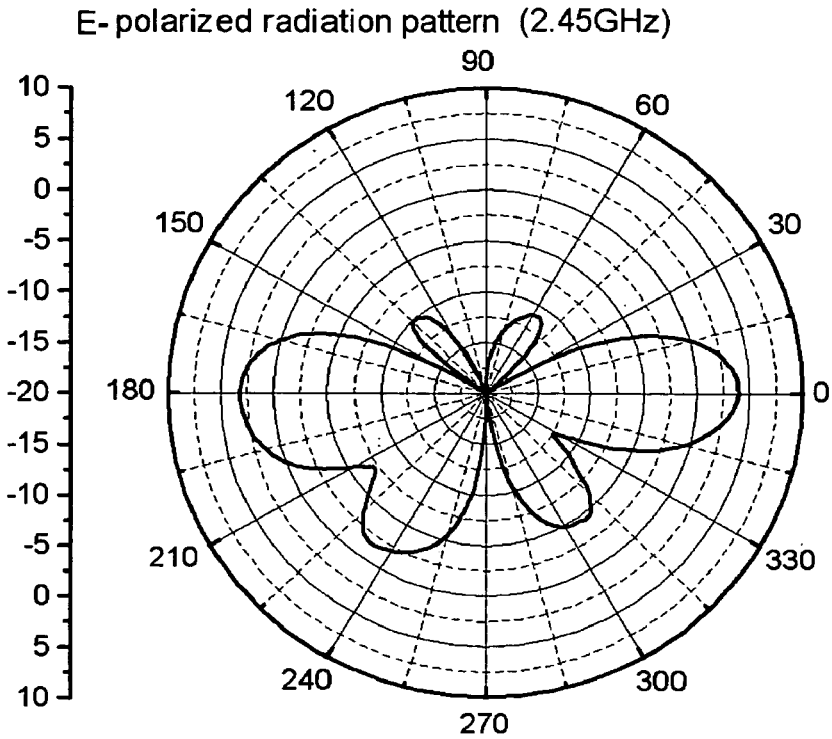
FIG. 3E is an E-polarized radiation pattern of the first frequency band according to the first embodiment of the present invention.
Figure 3F:
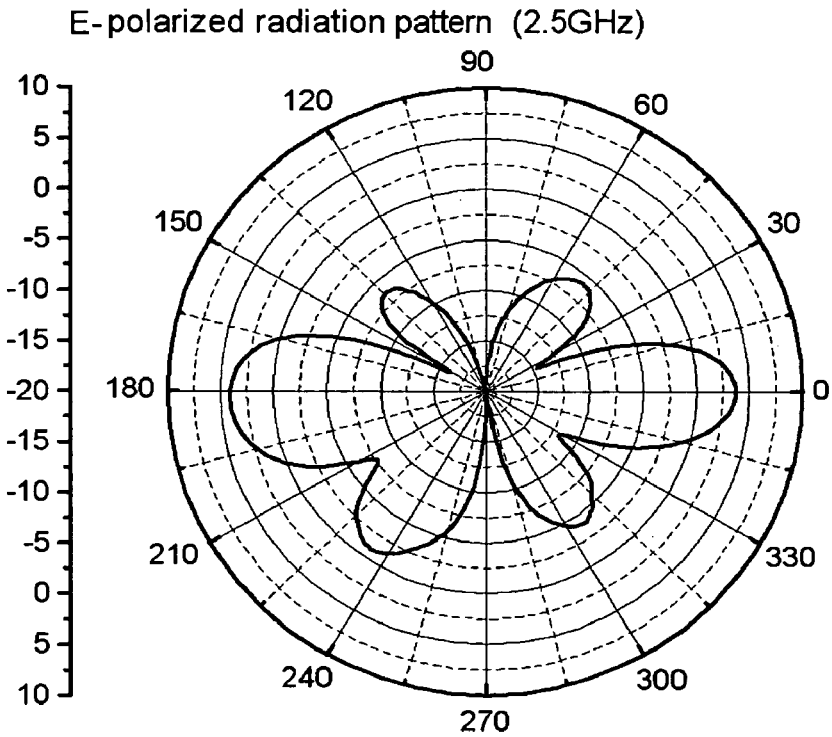
FIG. 3F is an E-polarized radiation pattern of the first frequency band according to the first embodiment of the present invention.
Figure 4A:
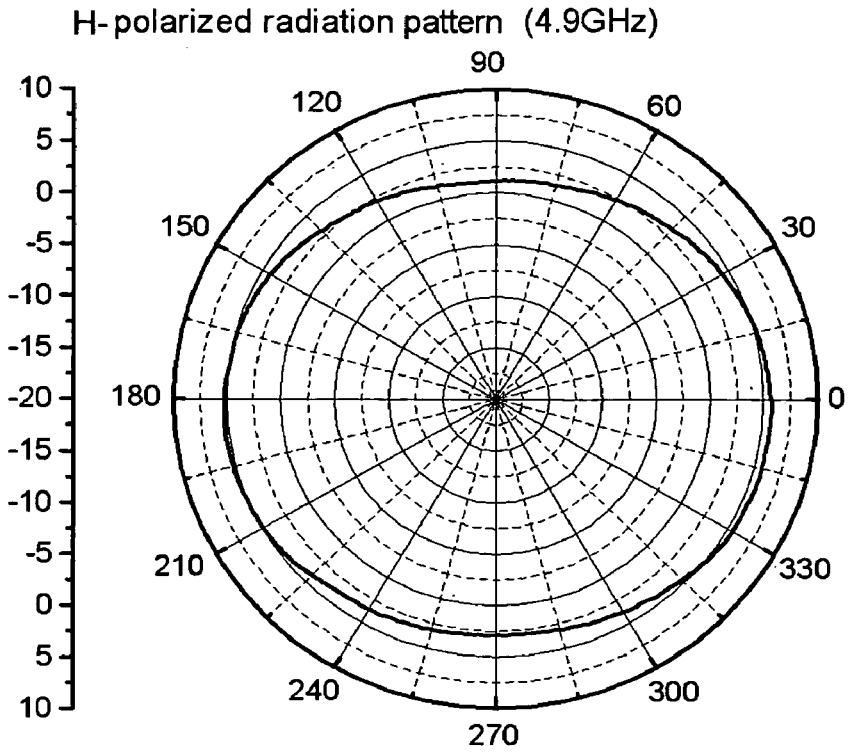
FIG. 4A is an H-polarized radiation pattern of the second frequency band according to the first embodiment of the present invention.
Figure 4B:
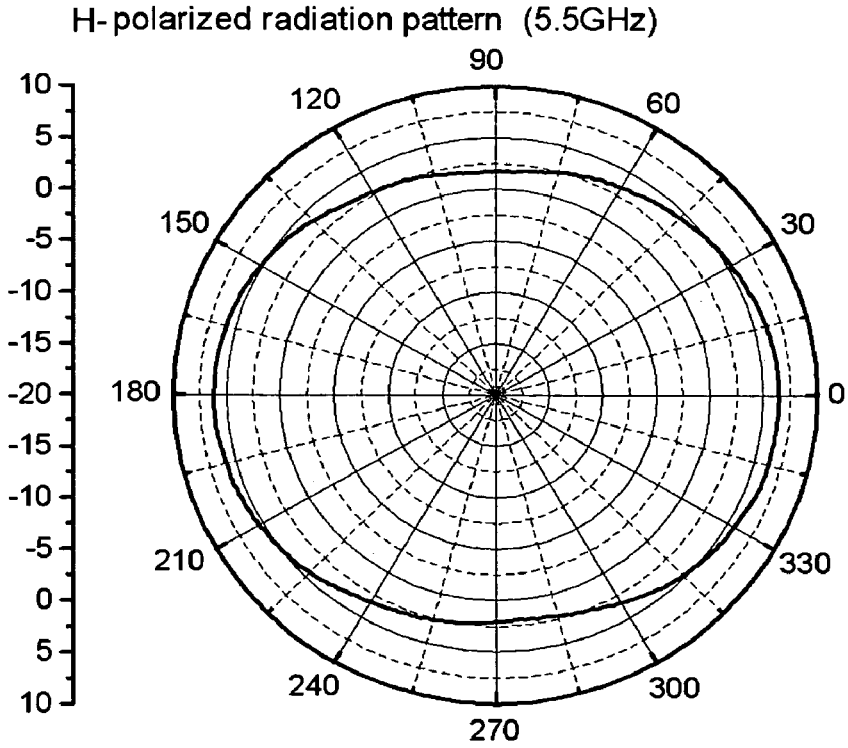
FIG. 4B is an H-polarized radiation pattern of the second frequency band according to the first embodiment of the present invention.
Figure 4C:
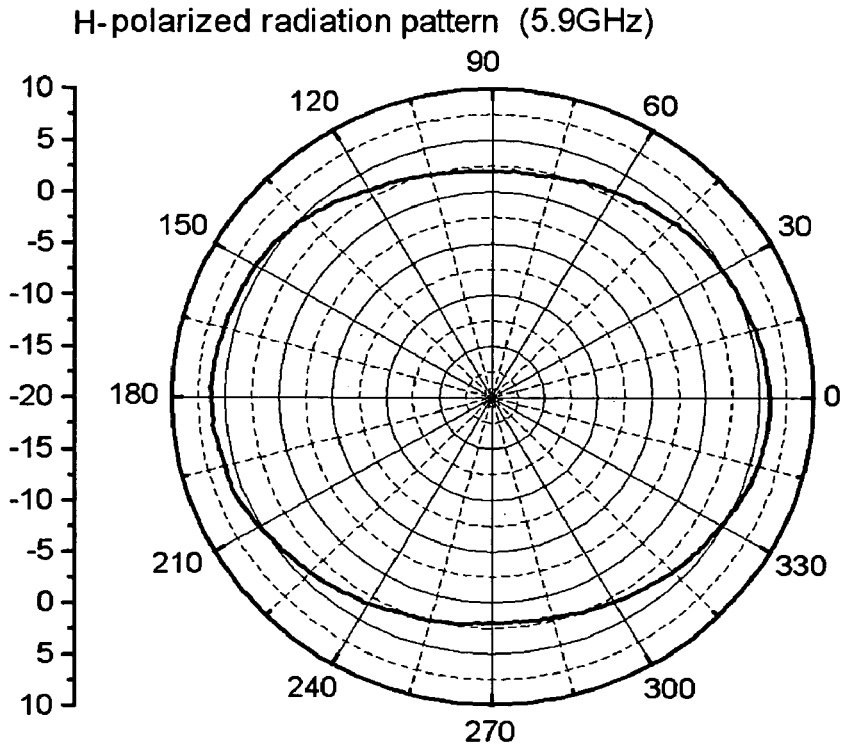
FIG. 4C is an H-polarized radiation pattern of the second frequency band according to the first embodiment of the present invention.
Figure 4D:
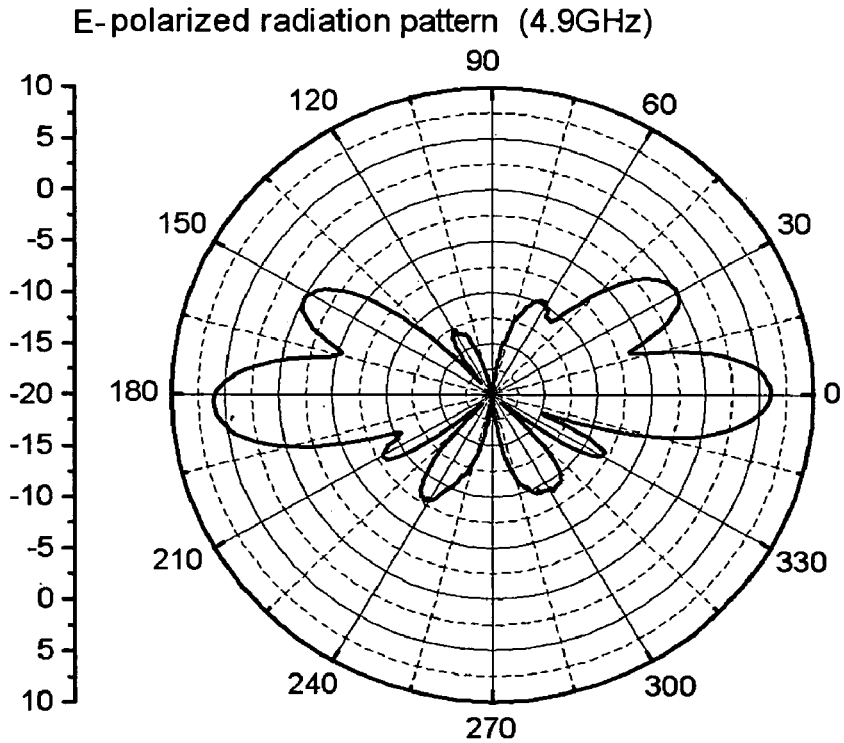
FIG. 4D is an E-polarized radiation pattern of the second frequency band according to the first embodiment of the present invention.
Figure 4E:
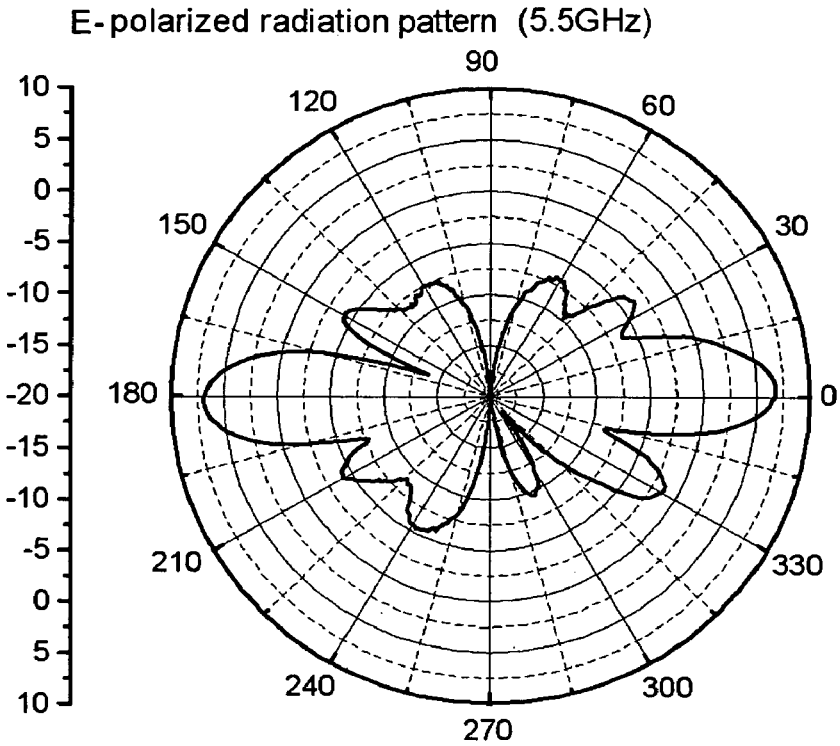
FIG. 4E is an E-polarized radiation pattern of the second frequency band according to the first embodiment of the present invention.
Figure 4F:
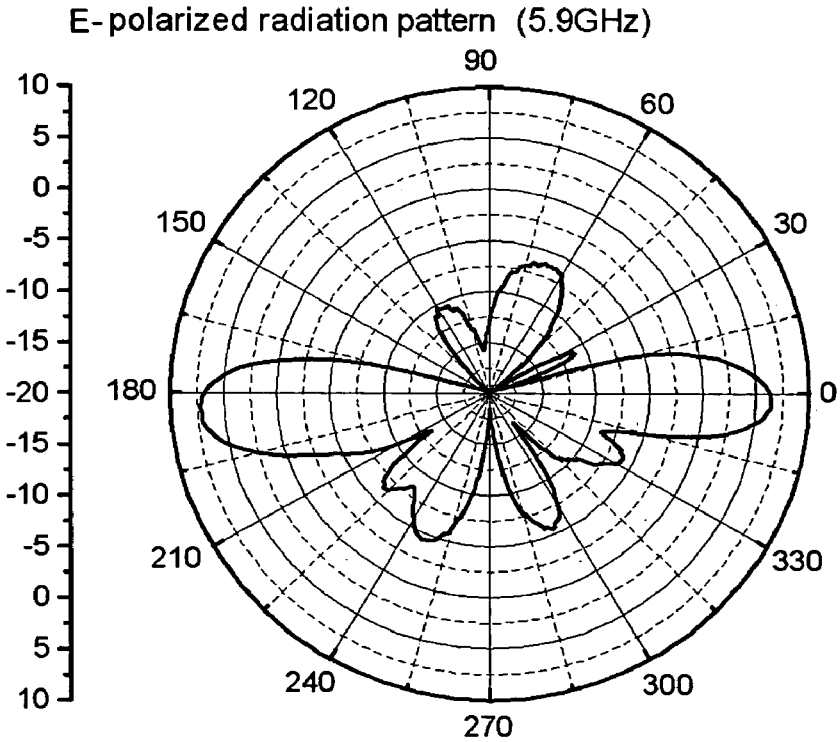
FIG. 4F is an E-polarized radiation pattern of the second frequency band according to the first embodiment of the present invention.

Referring to FIGS. 3A to 3C, they are H-polarized radiation patterns according to the first embodiment of the present invention, respectively taking frequencies 2.4 GHz, 2.45 GHz and 2.5 GHz in the first frequency band for different tests. Referring to FIGS. 3D to 3F, they are E-polarized radiation patterns according to the first embodiment of the present invention, respectively taking frequencies 2.4 GHz, 2.45 GHz and 2.5 GHz in the first frequency band for different tests. Referring to FIGS. 4A to 4C, they are H-polarized radiation patterns according to the first embodiment of the present invention, respectively taking frequencies 4.9 GHz, 5.5 GHz and 5.9 GHz in the second frequency band for different tests. Referring to FIGS. 4D to 4F, they are V-polarized radiation patterns according to the first embodiment of the present invention, respectively taking frequencies 4.9 GHz, 5.5 GHz and 5.9 GHz in the second frequency band for different tests.

With the dual-frequency high-gain antenna, a radio-frequency signal is transmitted and received through the diplexer loop portion, so as to provide the antenna with the characteristics of receiving/sending a signal, and the design of a single-frequency radiation section and a dual-frequency radiation section also enhances the signal receiving/sending gains of the antenna.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A dual-frequency high-gain antenna, comprising:

a diplexer loop portion, disposed at the center of the antenna substrate, for receiving a feed signal;

two single-frequency radiation units, symmetrically connected to two sides of the diplexer loop portion, for radiating the radio-frequency signal corresponding to a first frequency value of the feed signal; and two dual-frequency radiation units, connected to each single-frequency radiation portion, for radiating the radio-frequency signals corresponding to the first frequency value and a second frequency value of the feed signal.

2. The dual-frequency high-gain antenna as claimed in claim 1, wherein the single-frequency radiation portion further comprises a first frequency band radiation portion for radiating the radio-frequency signal of the first frequency value.

3. The dual-frequency high-gain antenna as claimed in claim 1, wherein the dual-frequency radiation portion further comprises a first frequency band radiation portion and a second frequency band radiation portion respectively for radiating the radio-frequency signals of the first frequency value and the second frequency value.

4. The dual-frequency high-gain antenna as claimed in claim 1, wherein the diplexer loop portion further comprises a first signal feed portion and a second signal feed portion.

5. The dual-frequency high-gain antenna as claimed in claim 1, wherein each of the single-frequency radiation units is of a dipole antenna structure.

6. The dual-frequency high-gain antenna as claimed in claim 1, wherein each of the dual-frequency radiation units is of a dipole antenna structure.

7. The dual-frequency high-gain antenna as claimed in claim 1, wherein the diplexer loop portion further comprises a meandering microstrip line section for connecting the first signal feed portion and the second signal feed portion.

8. A dual-frequency high-gain antenna, comprising:

a signal feed portion, disposed at the center of the antenna substrate, for receiving a feed signal;

two single-frequency radiation units, symmetrically connected to two sides of the signal feed portion, for radiating the radio-frequency signal corresponding to a first frequency value of the feed signal; and two dual-frequency radiation units, connected to each single-frequency radiation portion, for radiating the radio-frequency signals corresponding to the first frequency value and a second frequency value of the feed signal.

9. The dual-frequency high-gain antenna as claimed in claim 8, wherein the single-radiation portion further comprises a first frequency band radiation portion for radiating the radio-frequency signal of the first frequency value.

10. The dual-frequency high-gain antenna as claimed in claim 8, wherein the dual-frequency radiation portion further comprises a first frequency band radiation portion and a second frequency band radiation portion respectively for radiating the radio-frequency signals of the first frequency value and the second frequency value.

11. The dual-frequency high-gain antenna as claimed in claim 8, wherein each of the single-frequency radiation units is of a dipole antenna structure.

12. The dual-frequency high-gain antenna as claimed in claim 8, wherein each of the dual-frequency radiation units is of a dipole antenna structure.

* * * * *